US008800655B1

(12) United States Patent
Bailey

(10) Patent No.: US 8,800,655 B1
(45) Date of Patent: Aug. 12, 2014

(54) STAGE CEMENTING TOOL

(76) Inventor: Michael E. Bailey, Azle, TX (US)

( * ) Notice: Subject to any disclaimer, the term of this patent is extended or adjusted under 35 U.S.C. 154(b) by 333 days.

(21) Appl. No.: 13/019,260

(22) Filed: Feb. 1, 2011

Related U.S. Application Data

(60) Provisional application No. 61/300,128, filed on Feb. 1, 2010.

(51) Int. Cl.
*E21B 33/14* (2006.01)

(52) U.S. Cl.
USPC ..... 166/289; 166/177.4; 166/318; 166/332.1

(58) Field of Classification Search
USPC ..... 166/289, 318, 332.1, 177.4
See application file for complete search history.

(56) References Cited

U.S. PATENT DOCUMENTS

| | | | | |
|---|---|---|---|---|
| 4,176,717 | A * | 12/1979 | Hix | 166/289 |
| 4,674,569 | A * | 6/1987 | Revils et al. | 166/154 |
| 5,048,611 | A * | 9/1991 | Cochran | 166/374 |
| 5,348,089 | A * | 9/1994 | Brandell et al. | 166/154 |
| 2002/0000318 | A1 * | 1/2002 | Allamon et al. | 166/291 |

* cited by examiner

*Primary Examiner* — Jennifer H Gay
*Assistant Examiner* — Taras P Bemko
(74) *Attorney, Agent, or Firm* — Law Office of J. D. Pemberton

(57) ABSTRACT

A mechanical stage cementing tool that includes a mechanical opening and closing seat sleeve and a pin sub. The mechanical stage cementing tool may be converted to a hydraulic stage cementing tool by inserting a hydraulic tube assembly into the mechanical opening and closing seat sleeve at a hydraulic modification area and by adding a hydraulic seat to the pin sub. The stage cementing tool has a running-in-hole position, an open position, and a closed position.

20 Claims, 7 Drawing Sheets

Fig. 1
| Fig. 1A |
| --- |
| Fig. 1B |
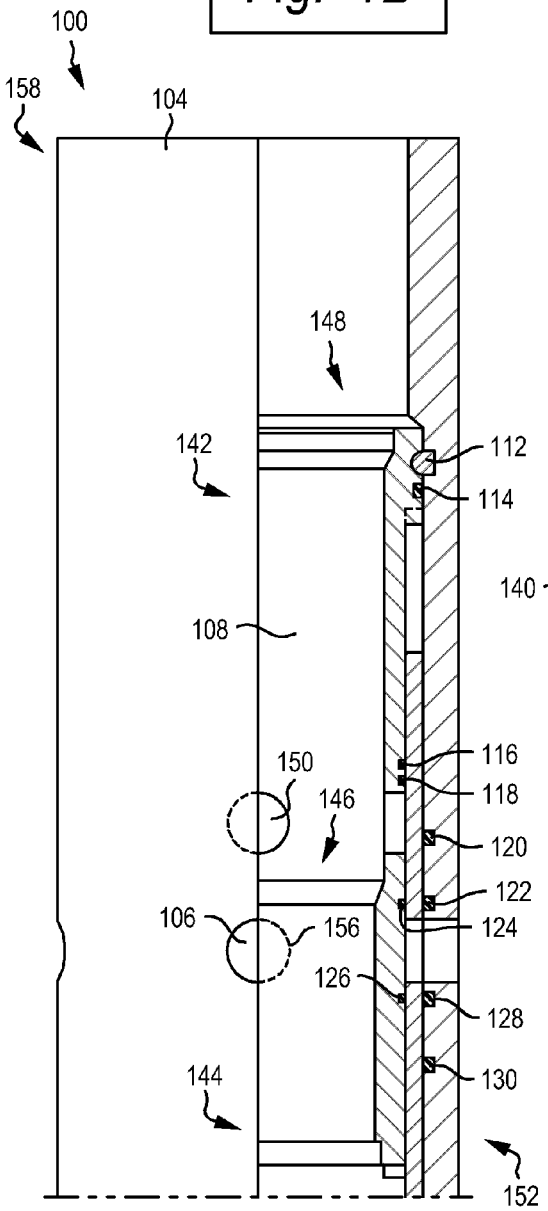
Fig. 1A
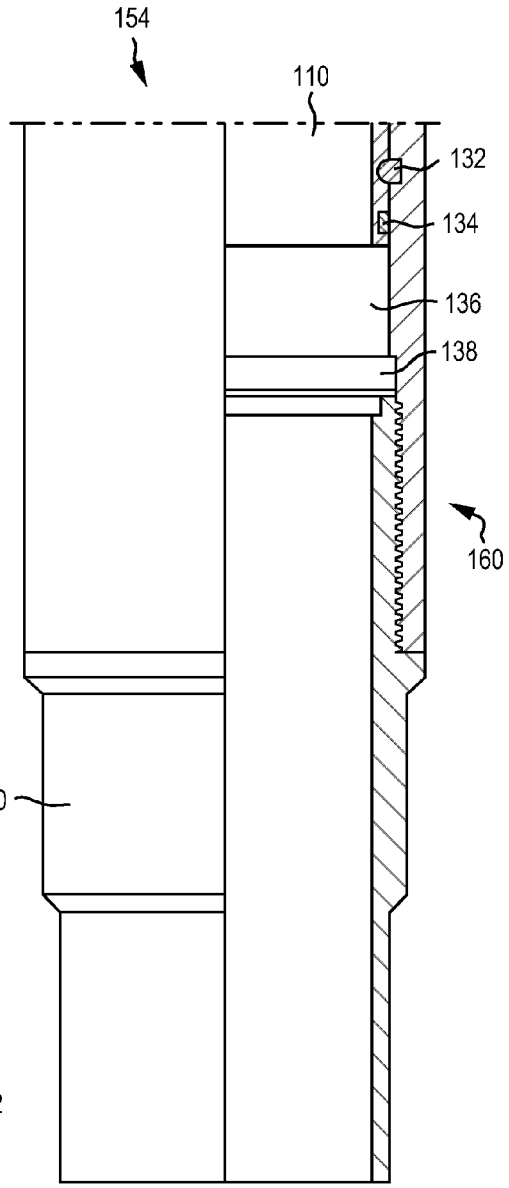
Fig. 1B

Fig. 2
| Fig. 2A |
| --- |
| Fig. 2B |
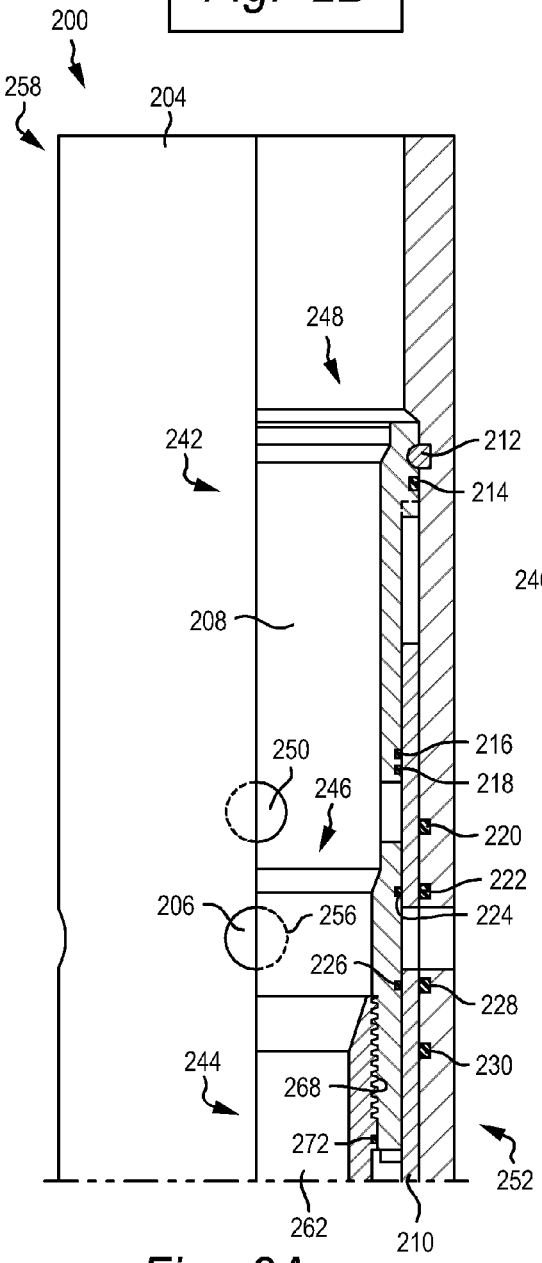
Fig. 2A
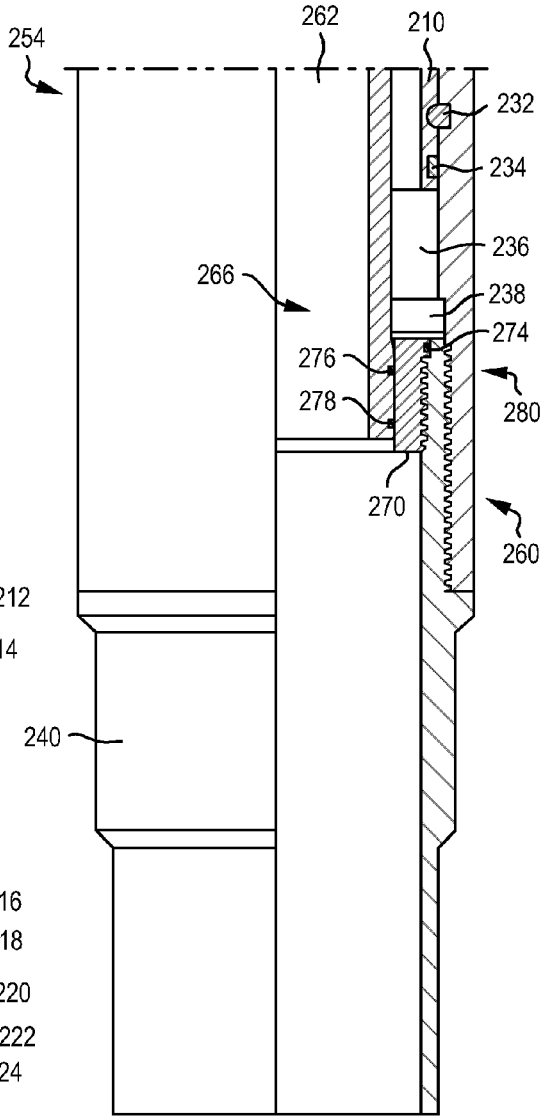
Fig. 2B

STAGE CEMENTING TOOL

I. CROSS-REFERENCE TO RELATED APPLICATION

The present disclosure claims the benefit of U.S. Provisional Application No. 61/300,128 filed Feb. 1, 2010, which is incorporated by reference herein in its entirety and to which priority is claimed.

II. FIELD

The present disclosure is generally related to stage cementing.

III. DESCRIPTION OF RELATED ART

The earliest known oil wells were drilled in China in around 347 AD. The wells were drilled using bits attached to bamboo poles and could reach depths of about 800 feet. The oil recovered from the wells was burned to evaporate brine and produce salt. Around 1858, the first North American oil well drilled in Ontario, Canada.

It is commonly believed that the modern oil industry was born on a hill in southeastern Texas commonly known as Spindletop. Around 1900, drilling began at Spindletop but the drilling was difficult because the drill hole had to go through several hundred feet of sand and the sand made the drill holes prone to cave-ins. In modern hydrocarbon production, or oil and gas production, strings of pipe, commonly known as casing or a casing string, are used to prevent unstable upper formations from caving-in and sticking the drill string or forming large caverns, also called washouts.

Casing the borehole, or wellbore, aids the drilling process in several ways including but not limited to: preventing contamination of fresh water well zones; providing a strong upper foundation to use high-density drilling fluid to continue drilling deeper; isolating different zones that may have different pressures or fluids from one zone to another; sealing off high pressure zones from the surface, reducing the potential for a blowout; preventing fluid loss into or contamination of production zones; and providing a smooth internal bore for installing production equipment.

The casing in a wellbore permits the well driller to control the well while drilling operations are ongoing, as well as to allow control of the well while the hydrocarbons are being produced. As used herein, the term "wellbore" means either an open or drilled wellbore, or a cased hole, which already has a length of casing installed therein. The casing is typically permanently installed in the wellbore by cementing the casing to the wellbore by pumping annular casing fluid into an annular cavity between the outside of casing and the wellbore. The currently run casing is used as a conduit for the annular casing fluid and the annular casing fluid flows through open ports in the casing and into the annular cavity. In most instances, a casing string is permanently installed, by cementing the casing string within a larger diameter casing string that was previously set and an open hole is drilled below the previously set larger diameter casing string to continue the wellbore.

In some instances, the entire length of casing string cannot be cemented within the wellbore by pumping annular casing fluid outwardly from the lower end of the casing string and then upward along the entire length of the casing string. In that instance, a procedure generally known as "two-stage cementing" is used.

Two-stage cementing is where annular casing fluid is mixed and pumped into an annular cavity between the casing string and the wellbore from two different locations along the length of the casing string. The first location where the annular casing fluid is pumped into the annular cavity is at the bottom of the casing string, commonly referred to as the first stage cementing position. The second location where the annular casing fluid is pumped into the annular cavity is commonly referred to as the second stage cementing position and is located between the top and the bottom of the casing string. At the second location, a down-hole tool, such as a stage cementing collar is installed. The stage cementing collar has fluid ports to allow the annular casing fluid to be pumped into the annular cavity between the casing string and the wellbore. In the open position, the fluid ports extend from the interior of the cementing collar to the annular cavity between the casing string and the wellbore and allow the annular casing fluid to flow from the interior of the cementing collar in the casing string to the annular cavity in the wellbore. Sometimes a three or even a fourth stage cementing procedure is used in the same casing string. For example, if there is a third location, between the top of the casing string and the second stage cementing position, where the annular casing fluid is pumped into the annular cavity, then that position is referred to as the third stage cementing position. For clarity, only the two-stage cementing procedure will be described however, performing a three or fourth stage cementing procedure would follow approximately the same procedure.

IV. SUMMARY

In a particular embodiment, a stage cementing tool includes a barrel or casing, an opening and closing seat sleeve, a closing sleeve, and a pin sub. The opening and closing seat sleeve may be threaded to accept a hydraulic assembly such that the mechanical cementing tool can be converted to a hydraulic cementing tool. In another particular embodiment, the stage cementing tool includes a one piece three stage insert that reduces the inside diameter of the opening and closing seat sleeve so the stage cementing tool may be used in a three stage string casing.

In a particular embodiment, a stage cementing tool has a running-in-hole position, an open position, and a closed position. The stage cementing tool includes a mechanical opening and closing seat sleeve, a closing sleeve, and a pin sub. The mechanical opening and closing seat sleeve contains a hydraulic modification area, a bomb seat, a closing plug seat, and opening and closing sleeve shear means. The closing sleeve contains closing sleeve shear means, an upper snap ring groove that contains a snap ring, and a lower snap ring groove. In the closed position, the snap ring in the upper snap ring groove locks with the lower snap ring groove to secure the mechanical opening and closing seat sleeve and the closing sleeve in the closed position. The mechanical opening and closing seat sleeve can be converted to a hydraulic opening and closing seat sleeve by inserting a hydraulic tube assembly into the mechanical opening and closing seat sleeve at the hydraulic modification area and by adding a hydraulic seat to the pin sub.

In a particular embodiment, a method of casing a wellbore includes inserting a stage cementing tool into the wellbore. The stage cementing tool has a running-in-hole position, an open position, and a closed position. The stage cementing tool includes a mechanical opening and closing seat sleeve, a closing sleeve, and a pin sub. The mechanical opening and closing seat sleeve contains a hydraulic modification area and the mechanical opening and closing seat sleeve can be converted to a hydraulic opening and closing seat sleeve by inserting a hydraulic tube assembly into the mechanical opening and closing seat sleeve at the hydraulic modification area and by adding a hydraulic seat to the pin sub. The method further includes transitioning the stage cementing tool from the running-in-hole position into an open position such that in the open position casing fluid can flow into the wellbore, transitioning the stage cementing tool into a closed position, such that in the closed position, casing fluid cannot flow into the wellbore, and drilling out at least a portion of the stage cementing tool such that the wellbore is cased.

In a particular embodiment, a stage cementing tool has a running-in-hole position, an open position, and a closed position. The stage cementing tool contains a mechanical opening and closing seat sleeve, a closing sleeve, a barrel, and a pin sub. The stage cementing tool further includes a first sealing ring that provides a seal between a top portion of the mechanical opening and closing seat sleeve and an inside of the barrel, a second sealing ring that at least partially isolates mechanical opening and closing seat sleeve port holes from a top portion of the mechanical opening and closing seat sleeve, a fourth sealing ring that at least partially isolates the mechanical opening and closing seat sleeve port holes from the top portion of the mechanical opening and closing seat sleeve, a sixth sealing ring that at least partially isolates the mechanical opening and closing seat sleeve port holes from closing sleeve port holes, a seventh sealing ring that at least partially isolates the closing sleeve port holes and a bottom portion of the mechanical opening and the closing seat sleeve, and an eighth sealing ring, that at least partially isolates the mechanical opening and closing seat sleeve port holes and the closing sleeve port holes from barrel port holes. The mechanical opening and closing seat sleeve can be converted to a hydraulic opening and closing seat sleeve by inserting a hydraulic tube assembly into the mechanical opening and closing seat sleeve at the hydraulic modification area and by adding a hydraulic seat to the pin sub.

One particular advantage provided by at least one of the disclosed embodiments is that a mechanical opening and closing seat sleeve and be converted to a hydraulic opening and closing seat sleeve relatively easily. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

FIG. 1 is a cross sectional view of a mechanical stage cementing collar;

FIG. 2 is a cross sectional view of a hydraulic stage cementing collar;

VI. DETAILED DESCRIPTION

Figure 3:
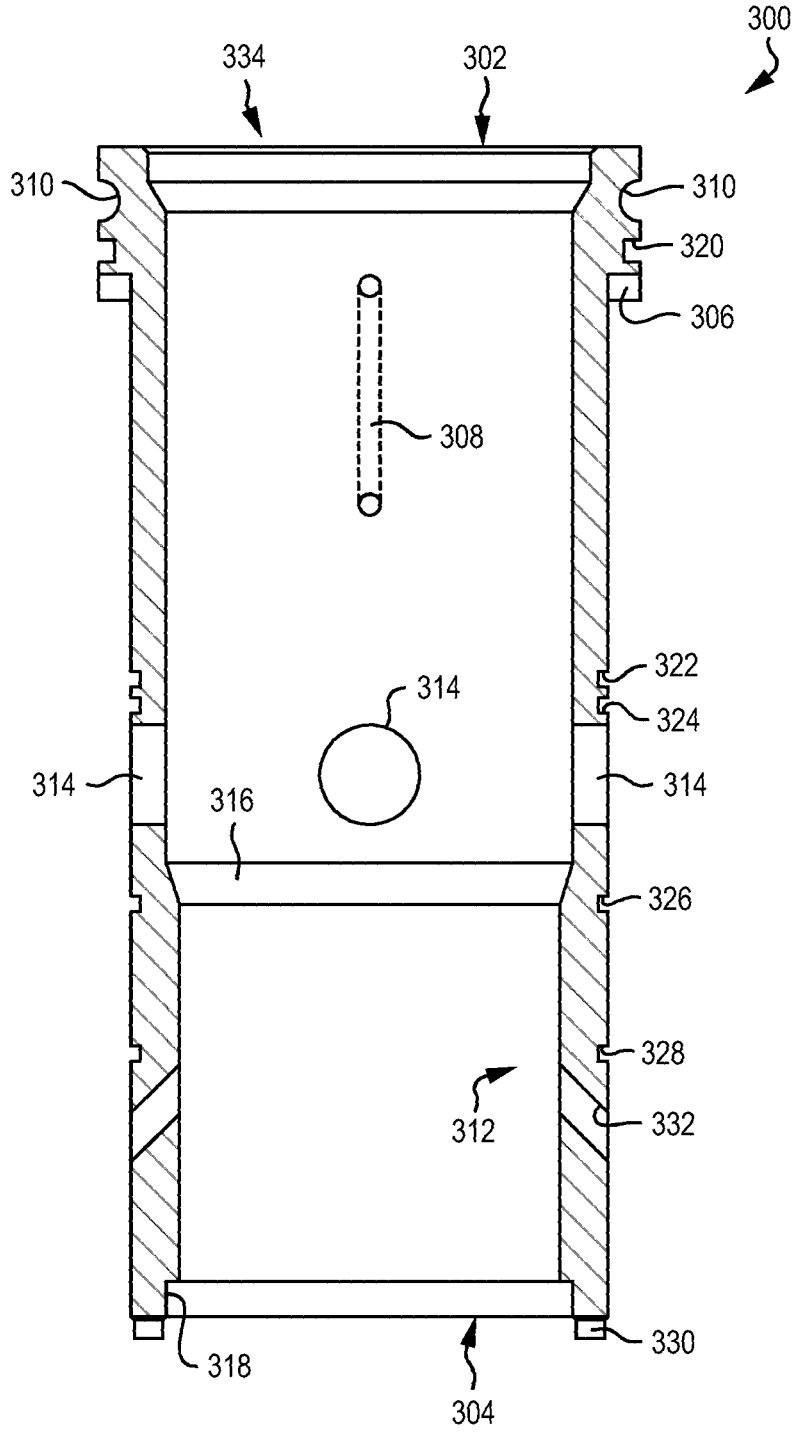
FIG. 3 is a cross sectional view of a mechanical opening and closing seat sleeve.

Referring to FIG. 1, an illustrative embodiment of a mechanical stage cementing collar is depicted and generally designated 100. The mechanical stage cementing collar 100 is a stage cementing tool. The mechanical stage cementing collar 100 includes a barrel 104 and barrel port holes 106. The mechanical stage cementing collar 100 has a top portion 158 and a bottom portion 160. Inside the barrel 104 is a mechanical opening and closing seat sleeve 108, a closing sleeve 110, opening and closing seat sleeve shear means 112, a first sealing ring 114, a second sealing ring 116, a third sealing ring 118, a fourth sealing ring 120, a fifth sealing ring 122, a sixth sealing ring 124, a seventh sealing ring 126, an eighth sealing ring 128, a ninth sealing ring 130, closing sleeve shear means 132, an upper snap ring groove 134 that contains a snap ring, a bore inside diameter 136, and a lower snap ring groove 138. A pin sub 140 is attached to the bottom portion 160 of the mechanical stage cementing collar 100. In a particular embodiment, the fifth sealing ring 120 is not present. In another particular embodiment, the ninth sealing ring 130 is not present. One reason the fifth sealing ring 120 and/or the ninth sealing ring 130 is not present is to shorten the overall length of the mechanical stage cementing collar 100.

The mechanical opening and closing seat sleeve 108 has a top portion 142 and a bottom portion 144. A bomb seat 146 is located near the bottom portion 144 of the mechanical opening and closing seat sleeve 108. A closing plug seat 148 is located near the top portion 142 of the mechanical opening and closing seat sleeve 108. Mechanical opening and closing seat sleeve port holes 150 are located between the top portion 142 and the bottom portion 144 of the mechanical opening and closing seat sleeve 108, above the bomb seat 146. The closing sleeve 110 has a top portion 152 and a bottom portion 154 and contains closing sleeve port holes 156 located near the top portion 152 of the closing sleeve 110.

The mechanical opening and closing seat sleeve shear means 112 and the first sealing ring 114 are located near the top portion 142 of the mechanical opening and closing seat sleeve 108. As explained in more detail below, the mechanical opening and closing seat sleeve shear means 112 releasable hold the mechanical opening and closing seat sleeve 108 in place during a running-in-hole position 702, shown in FIG. 7, until sufficient pressure is applied to shear the mechanical opening and closing seat sleeve shear means 112 and cause the mechanical opening and closing seat sleeve 108 to drop into an open position 704, shown in FIG. 7. The first sealing ring 114 at least partially isolates the top portion 142 of the mechanical opening and closing seat sleeve 108 from an inside of the barrel 104.

The second sealing ring 116 and the third sealing ring 118 are part of the mechanical opening and closing seat sleeve 108 and are in contact with the inside diameter of the closing sleeve 110. The second sealing ring 116 and the third sealing ring 118 are located between the mechanical opening and closing seat sleeve port holes 150 and the top portion 142 of the mechanical opening and closing seat sleeve 108. The second sealing ring 116 and the third sealing ring 118 at least partially isolate the mechanical opening and closing seat sleeve port holes 150 from the top portion 142 of the mechanical opening and closing seat sleeve 108. In a particular embodiment, the second sealing ring 116 is not present.

The fourth sealing ring 120 and the fifth sealing ring 122 are a part of the barrel 104 and are in contact with the outside diameter of the closing sleeve 110. The fourth sealing ring 120 and the fifth sealing ring 122 are located between the top portion 158 of the mechanical stage cementing collar 100 and the barrel port holes 106. For example, in a particular embodiment, the fourth sealing ring 120 and the fifth sealing ring 122 are located between the mechanical opening and closing seat sleeve port holes 150 and the barrel port holes 106 during the running-in-hole position 702, shown in FIG. 7. The fourth sealing ring 120 and the fifth sealing ring 122 at least partially isolate the top portion 158 of the mechanical stage cementing collar 100 from the barrel port holes 106.

The sixth sealing ring 124 is a part of the mechanical opening and closing seat sleeve 108 and is in contact with the inside diameter of the closing sleeve 110. The sixth sealing ring is located between the mechanical opening and closing seat sleeve port holes 150 and the bottom portion 144 of the mechanical opening and closing seat sleeve 108. For example, in a particular embodiment, the sixth sealing ring 124 is located between the mechanical opening and closing seat sleeve port holes 150 and the closing seat sleeve port holes 156. During the running-in-hole position 702, shown in FIG. 7, the sixth sealing ring 124 at least partially isolates the mechanical opening and closing seat sleeve port holes 150 from the closing sleeve port holes 156.

The seventh sealing ring 126 is a part of the mechanical opening and closing seat sleeve 108 and is in contact with the inside diameter of the closing sleeve 110. The seventh sealing ring is located between the sixth sealing ring 124 and the bottom portion 144 of the mechanical opening and closing seat sleeve 108. For example, in a particular embodiment, the seventh sealing ring 126 is located between the closing sleeve port holes 156 and the bottom portion 144 of the mechanical opening and closing seat sleeve 108. The seventh sealing ring 126 at least partially isolates the closing sleeve port holes 156 from the bottom portion 144 of the mechanical opening and closing seat sleeve 108.

The eighth sealing ring 128 and the ninth sealing ring 130 are a part of the barrel 104 and are in contact with the outside diameter of the closing sleeve 110. The eighth sealing ring 128 and the ninth sealing ring 130 are located between the barrel port holes 106 and the bottom portion 154 of the mechanical stage cementing collar 100. For example, in a particular embodiment, the eighth sealing ring 128 and the ninth sealing ring 130 are located between the barrel port holes 106 and the bottom portion 144 of the mechanical opening and closing seat sleeve 108 during the running-in-hole position 702, shown in FIG. 7. During a closed position 706, shown in FIG. 7, the eighth sealing ring 128 and the ninth sealing ring 130 at least partially isolate the mechanical opening and closing seat sleeve port holes 150 and the closing sleeve port holes 156 from the barrel port holes 106.

The closing sleeve shear means 132 are located near the bottom portion 154 of the closing sleeve 110. As explained in more detail below, the closing sleeve shear means 132 releasable hold the closing sleeve 110 during the running-in-hole position 702, shown in FIG. 7 and in an open position 704 shown in FIG. 7. After sufficient pressure is applied to shear the closing sleeve shear means 132, cause the mechanical opening and closing seat sleeve 108 and the closing sleeve 110 to drop into the closed position 706, shown in FIG. 7.

The upper snap ring groove 134 is located near the bottom portion 144 of the closing sleeve 110. The upper snap ring groove 134 contains a snap ring and in the closed position 706, shown in FIG. 7, the snap ring in the upper snap ring groove 134 locks with the lower snap ring groove 138 to hold the mechanical opening and closing seat sleeve 108 and the closing sleeve 110 in the closed position 706, shown in FIG. 7.

The mechanical stage cementing collar 100 is typically used when there is not a deviation of more than about 30 degrees between the surface and the location of the second stage cementing position. The mechanical stage cementing collar 100 typically is used with a weighted free-fall opening device dropped to free-fall in fluid inside the casing string. The weighted free-fall opening device is commonly referred to as a "bomb" because it has a bullet or bomb shape. The bomb lands in the bomb seat 146 of the mechanical opening and closing seat sleeve 108 and seals a portion of the mechanical stage cementing collar 100 so fluid cannot pass down the casing string beyond the seated bomb.

The sealed mechanical stage cementing collar 100 allows pump pressure supplied from the surface and into the casing string to pressurize the casing string between the surface and the bomb seat 146 of the mechanical opening and closing seat sleeve 108. The applied pressure shears the opening and closing seat sleeve shear means 112 causing the mechanical opening and closing seat sleeve 108 to drop into an open position 704, FIG. 7. The mechanical opening and closing seat sleeve port holes 150 line up with the closing sleeve port holes 156 and the barrel port holes 106 such that annular casing fluid in the casing string can flow through the mechanical opening and closing seat sleeve port holes 150, the closing sleeve port holes 156, and the barrel port holes 106 and into an annular cavity in a wellbore. In a particular embodiment, the annular casing fluid is cement, a cement polymer mixture, or some other fluid or fluid like material used to case the wellbore.

After the desired amount of annular casing fluid has been pumped through the casing string and into the annular cavity, a closing plug is placed in the casing string and pumped to the mechanical stage cementing collar 100 until the closing plug lands on the closing plug seat 148 of the mechanical opening and closing seat sleeve 108. The closing plug creates a sealing relationship, such that upon pumping a fluid, such as drilling mud, into the casing string, the closing plug applies a force to the mechanical opening and closing seat sleeve 108 and the closing sleeve 110 sufficient to shear the closing sleeve shear means 132.

Figure 5:
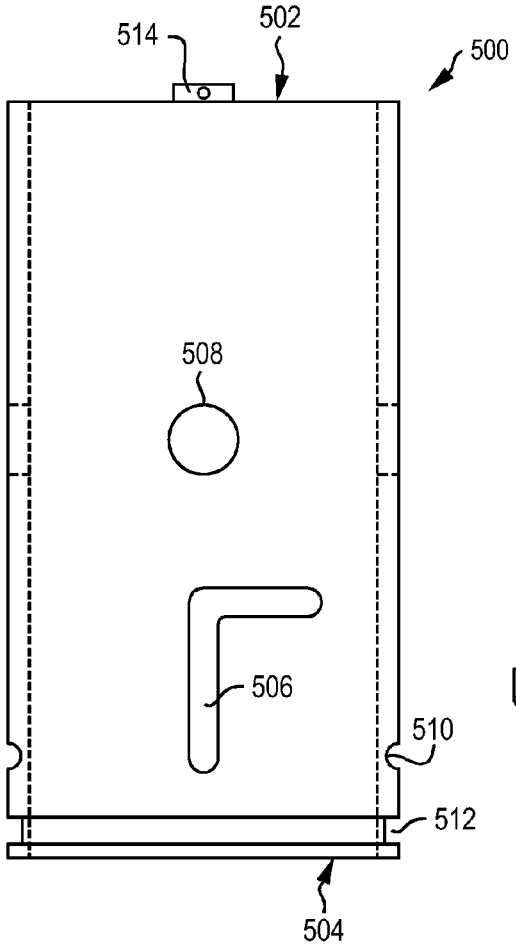
FIG. 5 is a cross sectional view of a closing sleeve.

Upon shearing the closing sleeve shear means 132, the opening and closing seat sleeve 108 and the closing sleeve 110 move together downwardly away from the barrel port holes 106 and seal off the mechanical opening and closing seat sleeve port holes 150 and the closing sleeve port holes 156 from the barrel port holes 106 such that the fluid ports are closed and the annular casing fluid cannot flow from the annular cavity in the wellbore back into the mechanical stage cementing collar 100. Also, the closing sleeve 110 slides into the bore inside diameter 136 and the upper snap ring groove 134 that contains the snap ring locks with the lower snap ring groove 138 to hold the mechanical opening and closing seat sleeve 108 and the closing sleeve 110 in the closed position 706, shown in FIG. 7. An L-slot 506, shown in FIG. 5, is milled on the outside diameter of the closing sleeve 110 and helps maintain the closed position and helps prevent rotation of the mechanical opening and closing seat sleeve 108 and the closing sleeve 110 during drill out. After the casing has set, the mechanical stage cementing collar is drilled out leaving the closing sleeve 110 secured to the bore inside diameter 136 to close off the barrel port hole 106 from the inside diameter of the barrel 104. With the typical right hand rotation of the drill bit, a keyway slot 308, show in FIG. 3, on the closing sleeve 110 is moved into the L-shaped slot 506, shown in FIG. 5, to help secure the hydraulic stage cementing collar 200 in the closed position. In a particular embodiment, the closing sleeve 110 is a sliding valve.

Referring to FIG. 2, an illustrative embodiment of a hydraulic stage cementing collar is depicted and generally designated 200. The hydraulic stage cementing collar 200 is a stage cementing tool. The hydraulic stage cementing collar 200 is similar to the mechanical stage cementing collar 100, shown in FIG. 1, wherein the mechanical stage cementing collar 100 has been converted to the hydraulic stage cementing collar 200. For example, the mechanical opening and closing seat sleeve 108, shown in FIG. 1, in the mechanical stage cementing collar 100, shown in FIG. 1, may be converted to a hydraulic opening and closing seat sleeve 208 by the insertion of a hydraulic tube assembly 262 into the mechanical opening and closing seat sleeve 108, shown in FIG. 1. In a particular embodiment, threads 268 are inserted into the bottom portion 244 of the mechanical opening and closing seat sleeve 108, shown in FIG. 1, to accommodate the hydraulic tube assembly 262 and convert the mechanical opening and closing seat sleeve 108, shown in FIG. 1, into the hydraulic opening and closing seat sleeve 208. In a particular embodiment, the mechanical stage cementing collar 100, shown in FIG. 1 is converted to the hydraulic stage cementing collar 200 at a manufacturing center. In a particular embodiment, the hydraulic tube assembly 262 is secured to the hydraulic opening and closing seat sleeve 208 with fasteners such as set screws.

The hydraulic stage cementing collar 200 includes a barrel 204 and barrel port holes 206. The barrel 204 and the barrel port holes 206 operate in a similar manner and are structurally equivalent to the barrel 104, shown in FIG. 1, and the barrel port holes 106, shown in FIG. 1, respectively. The hydraulic stage cementing collar 200 also includes the hydraulic opening and closing seat sleeve 208, the hydraulic tube assembly 262, opening and closing seat sleeve shear means 212, a first sealing ring 214, a second sealing ring 216, a third sealing ring 218, a fourth sealing ring 220, a fifth sealing ring 222, a sixth sealing ring 224, a seventh sealing ring 226, an eighth sealing ring 228, a ninth sealing ring 230, a tenth sealing ring 272, an eleventh sealing ring 274, a twelfth sealing ring 276, a thirteenth sealing ring 278, closing sleeve shear means 232, an upper snap ring groove 234 containing a snap ring, a bore inside diameter 236, a lower snap ring groove 238, a pin sub 240, and a hydraulic seat 270. The hydraulic stage cementing collar 200 has a top portion 258 and a bottom portion 260. The pin sub 240 is attached to the bottom portion 260 of the hydraulic stage cementing collar 200.

The opening and closing seat sleeve shear means 212 operate in a similar manner and are structurally equivalent to the opening and closing seat sleeve shear means 112, shown in FIG. 1, and in a particular embodiment, they are the same. The first sealing ring 214, second sealing ring 216, third sealing ring 218, fourth sealing ring 220, fifth sealing ring 222, sixth sealing ring 224, seventh sealing ring 226, eighth sealing ring 228, and ninth sealing ring 230 operate in a similar manner and are structurally equivalent to the first sealing ring 114, second sealing ring 116, third sealing ring 118, fourth sealing ring 120, fifth sealing ring 122, sixth sealing ring 124, seventh sealing ring 126, eighth sealing ring 128, and ninth sealing ring 130 respectively, each shown in FIG. 1, and in a particular embodiment, they are the same. The closing sleeve shear means 232 operate in a similar manner and are structurally equivalent to the closing sleeve shear means 132, shown in FIG. 1, and in a particular embodiment, they are the same. The upper snap ring groove 234 operates in a similar manner and is structurally equivalent to the upper snap ring groove 134, shown in FIG. 1, and in a particular embodiment, they are the same. The lower snap ring groove 238 operates in a similar manner and is structurally equivalent to the lower snap ring groove 138, shown in FIG. 1, and in a particular embodiment, they are the same. The pin sub 240 operates in a similar manner and is structurally equivalent to the pin sub 140, shown in FIG. 1, and in a particular embodiment, they are the same.

The hydraulic opening and closing seat sleeve 208 has a top portion 242 and the bottom portion 244. A closing plug seat 248 is located near the top portion 242 of the hydraulic opening and closing seat sleeve 208. The closing plug seat 248 operates in a similar manner and is structurally equivalent to the closing plug seat 148, shown in FIG. 1, and in a particular embodiment, they are the same. Hydraulic opening and closing seat sleeve port holes 250 are located between the top portion 242 and the bottom portion 244 of the hydraulic opening and closing seat sleeve 208. The hydraulic opening and closing seat sleeve port holes 250 operate in a similar manner and are structurally equivalent to the mechanical opening and closing seat sleeve port holes 150, shown in FIG. 1, and in a particular embodiment, they are the same. The closing sleeve 210 has a top portion 252 and a bottom portion 254 and contains closing sleeve port holes 256 located near the top portion 252 of the closing sleeve 210. The closing sleeve port holes 256 operate in a similar manner and are structurally equivalent to the closing sleeve port holes 156, shown in FIG. 1, and in a particular embodiment, they are the same.

The opening and closing seat sleeve shear means 212 and the first sealing ring 214 are located near the top portion 242 of the hydraulic opening and closing seat sleeve 208. As explained in more detail below, the opening and closing seat sleeve shear means 212 releasable hold the hydraulic opening and closing seat sleeve 208 during a running-in-hole position 802, shown in FIG. 8, until sufficient pressure is applied to shear the opening and closing seat sleeve shear means 212 and cause the hydraulic opening and closing seat sleeve 208 to drop into an open position 804, shown in FIG. 8. The first sealing ring 214 at least partially isolates the top portion 242 of the hydraulic opening and closing seat sleeve 208 from the inside of the barrel 204.

The second sealing ring 216 and the third sealing ring 218 are part of the hydraulic opening and closing seat sleeve 208 and are in contact with the inside diameter of the closing sleeve 210. The second sealing ring 216 and the third sealing ring 218 are located between the hydraulic opening and closing seat sleeve port holes 250 and the top portion 242 of the hydraulic opening and closing seat sleeve 208 and at least partially isolate the hydraulic opening and closing seat sleeve port holes 250 from the top portion 242 of the hydraulic opening and closing seat sleeve 208.

The fourth sealing ring 220 and the fifth sealing ring 222 are a part of the barrel 204 and are in contact with the outside diameter of the closing sleeve 210. The fourth sealing ring 220 and the fifth sealing ring 222 are located between the top portion 258 of the hydraulic stage cementing collar 200 and the barrel port holes 206. For example, in a particular embodiment, the fourth sealing ring 220 and the fifth sealing ring 222 are located between the hydraulic opening and closing seat sleeve port holes 250 and the barrel port holes 206 during the running-in-hole position 802, shown in FIG. 8.

The sixth sealing ring 224 is a part of the hydraulic opening and closing seat sleeve 208 and is in contact with the inside diameter of the closing seat sleeve. 210. The sixth sealing ring is located between the hydraulic opening and closing seat sleeve port holes 250 and the bottom portion 244 of the hydraulic opening and closing seat sleeve 208. For example, in a particular embodiment, the sixth sealing ring 224 is located between the hydraulic opening and closing seat sleeve port holes 250. During the running-in-hole position 802, shown in FIG. 8, the sixth sealing ring 224 at least partially isolates the hydraulic opening and closing seat sleeve port holes 250 from the closing sleeve port holes 256 and barrel port holes 206.

The seventh sealing ring 226 is a part of the hydraulic opening and closing seat sleeve 208 and is in contact with the inside diameter of the closing seat sleeve. 210. The seventh sealing ring is located between the sixth sealing ring 224 and the bottom portion 244 of the hydraulic opening and closing seat sleeve 208. For example, in a particular embodiment, the seventh sealing ring 224 is located between the closing sleeve port holes 256 and the bottom portion 244 of the hydraulic opening and closing seat sleeve 208.

The eighth sealing ring 228 and the ninth sealing ring 230 are a part of the barrel 204 and are in contact with the outside diameter of the closing sleeve 210. The eighth sealing ring 228 and the ninth sealing ring 230 are located between the barrel port holes 206 and the bottom portion 260 of the hydraulic stage cementing collar 200. For example, in a particular embodiment, the eighth sealing ring 228 and the ninth sealing ring 230 are located between the barrel port holes 206 and the bottom portion 244 of the mechanical opening and closing seat sleeve 208 during the running-in-hole position 802, shown in FIG. 8. During the closed position 806, shown in FIG. 8, the eighth sealing ring 228 and the ninth sealing ring 230 at least partially isolate the hydraulic opening and closing seat sleeve port holes 250 and the closing sleeve port holes 256 from the barrel port holes 206.

The tenth sealing ring 272 is part of the hydraulic tube 262 and is in contact with the hydraulic opening and closing seat sleeve 208. The tenth sealing ring 272 is located in a top portion of the hydraulic tube 262 under the threads 268. The tenth sealing ring 272 at least partially isolates the pressure inside the hydraulic tube 262 from the threads 268 and the hydraulic opening and closing seat sleeve 208.

The eleventh sealing ring 274 is part of the hydraulic seat 270 and is in contact with the pin sub 240. The eleventh sealing ring 274 is located above the area where the hydraulic seat 270 is threaded into the pin sub 240. The eleventh sealing ring 274 at least partially isolates the pressure in the hydraulic tube 262 and the pin sub 240 from the closing sleeve 210.

The twelfth sealing ring 276 and the thirteenth sealing ring 278 are part of the hydraulic tube 262 and are in contact with an inside diameter of the hydraulic seat 270. The twelfth sealing ring 276 and the thirteenth sealing ring 278 are located at a bottom portion 266 of the hydraulic tube 262. The twelfth sealing ring 276 and the thirteenth sealing ring 278 help keep a pressure differential in the upper portion 258 of the hydraulic stage cementing collar 200 and in the lower portion 260 of the hydraulic stage cementing collar 200 to prevent pressure from prematurely shearing the shear means 232 on the closing sleeve 210.

The closing sleeve shear means 232 are located near the bottom portion 254 of the closing sleeve 210. As explained in more detail below, the closing seat sleeve shear means 232 releasable hold the closing seat sleeve 210 during the running-in-hole position, shown in FIG. 8 and in the open position shown in FIG. 8 until sufficient pressure is applied to shear the closing sleeve shear means 232 and cause the hydraulic opening and closing seat sleeve 208 and the closing sleeve 210 to drop into a closed position 806, shown in FIG. 8.

The upper snap ring groove 234 contains a snap ring and is located near the bottom portion 254 of the closing sleeve 210. The upper snap ring groove 234 locks with the lower snap ring groove 238 to hold the hydraulic opening and closing seat sleeve 208 and the closing sleeve 210 in the closed position 806, shown in FIG. 8. An L-slot 506, shown in FIG. 5, is milled on an outside diameter of the closing sleeve 210 and helps prevent rotation of the hydraulic opening and closing seat sleeve 208 and the closing sleeve 210 during drill out.

The hydraulic seat 270 is located near the bottom portion 260 of the hydraulic stage cementing collar 200 and is attached to the pin sub 240. The hydraulic tube 262 and hydraulic seat 270 help prevent pressure from pushing up from the bottom portion 260 of the closing sleeve 210 and causing the shear means 232 to shear before the shear means 212 in the hydraulic opening and closing seat sleeve 208 shear.

The hydraulic stage cementing collar 200 is typically used if there is a deviation greater than about 30 degrees in the casing string between the surface and where the second stage is determined to be cemented because if a bomb were used when there is a deviation greater than 30 degrees, the bomb can become stuck in the casing string above the hydraulic opening and closing seat sleeve 208 and not fall completely to the hydraulic opening and closing seat sleeve 208. The hydraulic stage cementing collar 200 may also be used if the free-fall time of a bomb would be greater than about 60 minutes or if there is a possibility of the first stage annular casing fluid being above the second stage tool. The first stage annular casing fluid can be above the second stage tool when the total volume of annular casing fluid mixed and pumped exceeds the capacity of the annular space from a float shoe to the stage collar, thus causing annular casing fluid to be above the stage collar. One advantage of the hydraulic stage cementing collar 200 over the mechanical stage cementing collar 100 in FIG. 1 is that the hydraulic stage cementing collar 200 can sometimes be opened just after a first stage cement job is complete.

Figure 8:
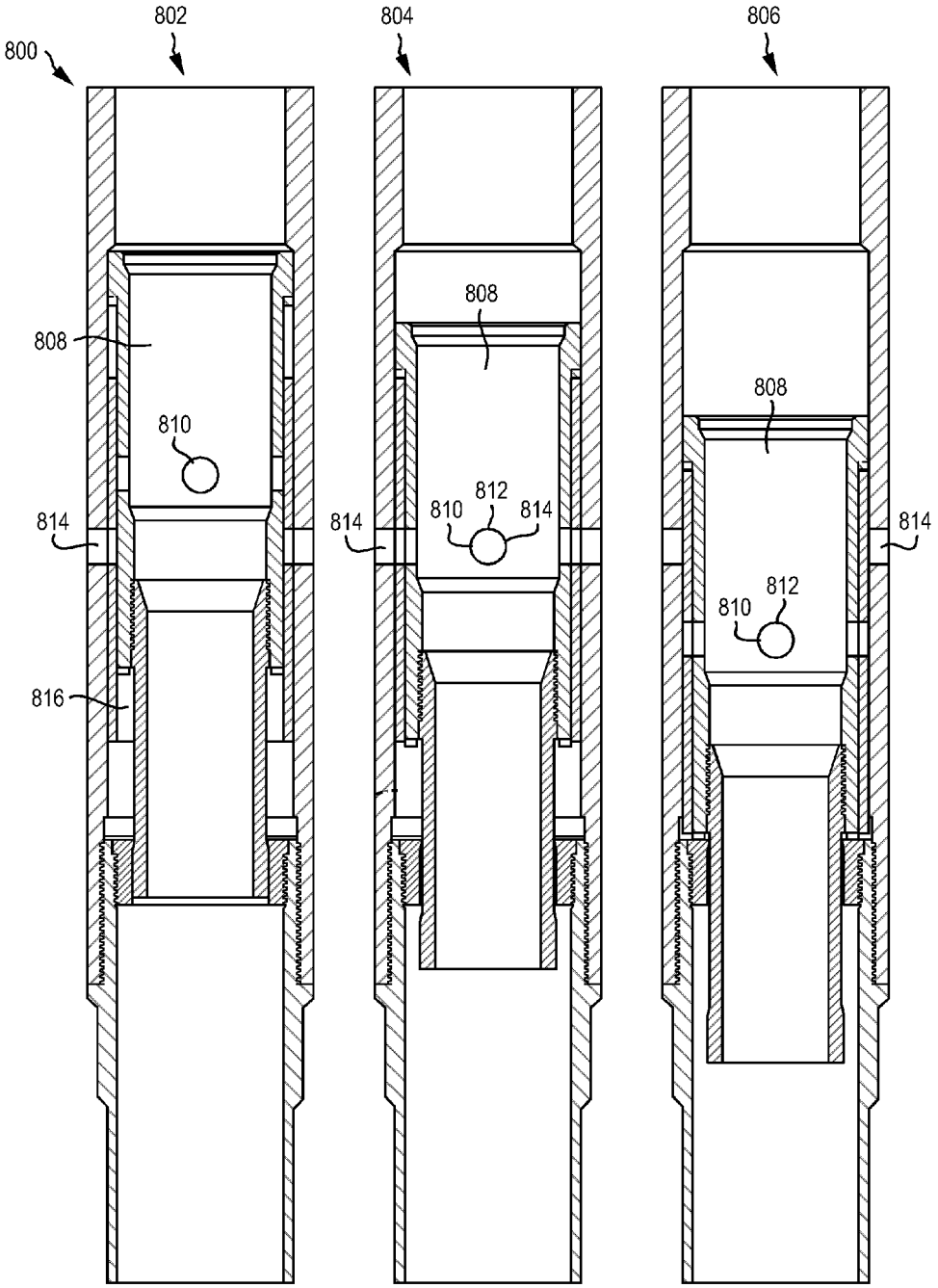
FIG. 8 is a cross sectional view of various stages of a hydraulic stage cementing collar in use.

To move the hydraulic stage cementing collar 200 from a running-in-hole position 802, shown in FIG. 8, to an open position 804, shown in FIG. 8, pump pressure is supplied from the surface when a first stage annular casing fluid plug is seated on a float collar at the bottom of the casing string, thereby pressurizing the entire casing string. Sufficient pressure is applied from the surface to shear the opening and closing seat sleeve shear means 212 allowing the hydraulic opening and closing seat sleeve 208 to drop into an open position 804, shown in FIG. 8, where the hydraulic opening and closing seat sleeve port holes 250 line up with the closing sleeve port holes 256, and the barrel port holes 206 such that annular casing fluid in the casing string can flow through the hydraulic opening and closing seat sleeve port holes 250, the closing sleeve port holes 256, and the barrel port holes 206 and into an annular cavity.

The float collar is a component installed near the bottom of the casing string where the first stage annular casing fluid plug lands during the primary cementing operation. The float collar typically consists of a short length of casing fitted with a check valve assembly. Because the density of annular casing fluid slurry is greater than the displacement density of the mud inside the casing string, the annular casing fluid slurry placed in the annulus could U-tube, or reverse flow back into the casing. The check-valve assembly fixed within the float collar at least partially prevents backflow of the annular casing fluid slurry when pumping is stopped. The check valve assembly may be a flapper-valve type, a spring-loaded ball valve, or some other type of check-valve assembly that at least partially prevents backflow of the annular casing fluid slurry when pumping is stopped.

After the desired amount of annular casing fluid has been pumped through the casing string and into the annular cavity, a closing plug is placed in the casing string and pumped to the hydraulic stage cementing collar 200 until the closing plug lands on the closing plug seat 248 of the hydraulic opening and closing seat sleeve 208. The closing plug creates a sealing relationship, such that upon pumping a fluid, such as drilling mud, into the casing string, the closing plug applies a force to the hydraulic opening and closing seat sleeve 208 and the closing sleeve 210 sufficient to shear the closing sleeve shear means 232. Upon shearing the closing sleeve shear means 232, the hydraulic opening and closing seat sleeve 208 and the closing sleeve 210 move together downwardly away from the barrel port holes 206 to seal off the hydraulic opening and closing seat sleeve port holes 250 and the closing sleeve port holes 256 from the barrel port holes 206 such that the fluid ports are closed and the annular casing fluid cannot flow from the annular cavity in the wellbore back into the hydraulic stage cementing collar 200.

The closing sleeve 210 snap ring 234 secures the hydraulic opening and closing seat sleeve 208 and the closing sleeve 210 in the locked down closed position. The anti-rotation slot 506, shown in FIG. 5, helps prevent rotation of the hydraulic opening and closing seat sleeve 208 and the closing sleeve 210 during drill out. The hydraulic stage cementing collar is drilled out leaving the closing sleeve 210 secured in the closed position and with the right hand rotation of the drill bit, a keyway slot 408, shown in FIG. 4, on the closing sleeve 210 is moved into the L-shaped slot 506, shown in FIG. 5, to help secure the hydraulic stage cementing collar 200 in the closed position.

Referring to FIG. 3, a particular illustrative embodiment of a mechanical opening and closing seat sleeve depicted and generally designated 300. The mechanical opening and closing seat sleeve 300 operates in a similar manner and is structurally equivalent to the mechanical opening and closing seat sleeve 108, shown in FIG. 1. The mechanical opening and closing seat sleeve 300 contains an anti-rotation receptacle 306, a key way slot 308, shear means receptacle 310, a hydraulic modification area 312, mechanical opening and closing seat sleeve port holes 314, a bomb seat 316, a sealing ring seat 318, a first sealing ring 320, a second sealing ring 322, a third sealing ring 324, a fourth sealing ring 326, a fifth sealing ring 328, an anti-rotation lug 330, three-stage set screw channels 332, and a closing plug seat 334.

The mechanical opening and closing seat sleeve port holes 314 operate in a similar manner and are structurally equivalent to the mechanical opening and closing seat sleeve port holes 150, shown in FIG. 1. The bomb seat 316 operates in a similar manner and is structurally equivalent to the bomb seat 146, shown in FIG. 1. The first sealing ring 320, second sealing ring 322, third sealing ring 324, fourth sealing ring 326, and fifth sealing ring 328 operate in a similar manner and are structurally equivalent to the first sealing ring 114, second sealing ring 116, third sealing ring 118, fourth sealing ring 120, and fifth sealing ring 122 respectively, shown in FIG. 1. The closing plug seat 334 operates in a similar manner and is structurally equivalent to the closing plug seat 148, shown in FIG. 1.

The mechanical opening and closing seat sleeve 300 has a top portion 302 and a bottom portion 304. The top portion 302 includes the closing plug seat 334, the anti-rotation receptacle 306, the key way slot 308, the shear means 310, and the first sealing ring 320. The top portion 302 is flared to accommodate a closing plug in the closing plug seat 334. The bottom portion 304 includes the fifth sealing ring 328, the hydraulic modification area 312, the sealing ring seat 318, the three-stage insert set screw channels 332, and the anti-rotation lug 330. Interposed between the top portion 302 and the bottom portion 304 is the second sealing ring 322, the third sealing ring 324, the mechanical opening and closing seat sleeve port holes 314, the bomb seat 316, and the fourth sealing ring 326.

The anti-rotation receptacle 306 and key way slot 308 help prevent rotation of the mechanical opening and closing seat sleeve 300 during drilling operations and have two main functions. First the key way slot 308 maintains port alignment when the mechanical stage cementing collar 100, shown in FIG. 1 and the casing string are run into the wellbore in a running-in-hole position 702, shown in FIG. 7. Second, the key way slot 308 guides an anti-rotation tab, described in more detail below, on the closing sleeve 110, shown in FIG. 1 to maintaining port alignment during both the open position 704, shown in FIG. 7, and the closed position 706, shown in FIG. 7, of the mechanical stage cementing collar 100, shown in FIG. 1. During drill-out, the anti-rotation tab 514, shown in FIG. 5, on the closing sleeve 500, shown in FIG. 5 meshes with the anti-rotation receptacle 306 and locks the mechanical opening and closing seat sleeve 300 to help prevent rotation.

Figure 4:
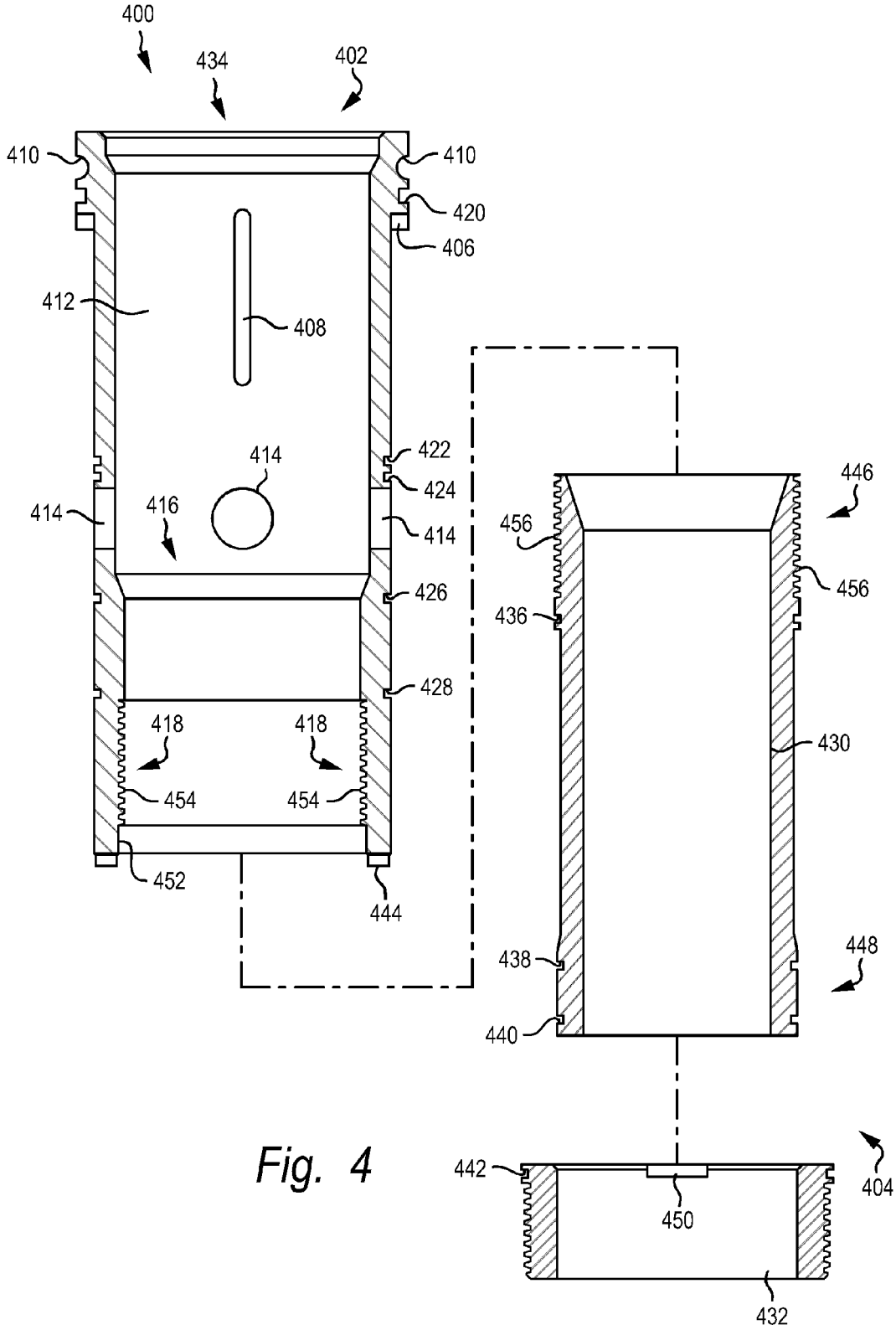
FIG. 4 is a cross sectional view of a hydraulic opening and closing seat sleeve.

Referring to FIG. 4, a particular illustrative embodiment of an exploded view of a hydraulic opening and closing seat sleeve is depicted and generally designated 400. The hydraulic opening and closing seat sleeve 400 operates in an equivalent manner and is structurally equivalent to the hydraulic opening and closing seat sleeve 208, shown in FIG. 2. The hydraulic opening and closing seat sleeve 400 contains an anti-rotation receptacle 406, a key way slot 408, shear means receptacle 410, a modified mechanical opening and closing seat sleeve 412, hydraulic opening and closing seat sleeve port holes 414, a bomb seat 416, hydraulic modification area 418, a first sealing ring 420, a second sealing ring 422, a third sealing ring 424, a fourth sealing ring 426, a fifth sealing ring 428, a hydraulic tube assembly 430, a hydraulic seat 432, a closing plug seat 434, a tenth sealing ring 436, a twelfth sealing ring 438, a thirteenth sealing ring 440, an eleventh sealing ring 442, an anti-rotation lug 444, a sealing ring seat 452, and threads 454.

The hydraulic opening and closing seat sleeve port holes 414 operate in a similar manner and are structurally equivalent to the hydraulic opening and closing seat sleeve port holes 250, shown in FIG. 2. The bomb seat 416 operates in a similar manner and is structurally equivalent to the bomb seat 246, shown in FIG. 2. The first sealing ring 420, second sealing ring 422, third sealing ring 424, fourth sealing ring 426, and fifth sealing ring 428 operate in a similar manner and are structurally equivalent to the first sealing ring 214, second sealing ring 216, third sealing ring 218, fourth sealing ring 220, and fifth sealing ring 222 respectively, shown in FIG. 2. The hydraulic tube assembly 430 operates in a similar manner and is structurally equivalent to the hydraulic tube assembly 262, shown in FIG. 2. The hydraulic seat 432 operates in a similar manner and is structurally equivalent to the hydraulic seat 270, shown in FIG. 2. The closing plug seat 434 operates in a similar manner and is structurally equivalent to the closing plug seat 248, shown in FIG. 2. The tenth sealing ring 436, eleventh sealing ring 442, twelfth sealing ring 438, and thirteenth sealing ring 440 operate in a similar manner and are structurally equivalent to the tenth sealing ring 272, eleventh sealing ring 274, twelfth sealing ring 276, and thirteenth sealing ring 278, respectively, shown in FIG. 2. The threads 454 operate in a similar manner and are structurally equivalent to the threads 268 shown in FIG. 2.

The hydraulic opening and closing seat sleeve 400 has a top portion 402 and a bottom portion 404. The top portion 402 includes the modified mechanical opening and closing seat sleeve 454. The modified mechanical opening and closing seat sleeve 412 contains the anti-rotation receptacle 406, the key way slot 408, the shear means 410, the first sealing ring 420, the second sealing ring 422, the third sealing ring 424, the fourth sealing ring 426, the fifth sealing ring 428, the hydraulic opening and closing seat sleeve port hole 414, the hydraulic modification area 418, the bomb seat 416, and the closing plug seat 434. The anti-rotation receptacle 406, the key way slot 408, the shear ball receptacle 410, the first sealing ring 420, the second sealing ring 422, the third sealing ring 424, the fourth sealing ring 426, the fifth sealing ring 428, the hydraulic opening and closing seat sleeve port hole 414, the hydraulic modification area 418, the bomb seat 416, and the closing plug seat 434 operate in an equivalent manner and are structurally equivalent to the anti-rotation receptacle 306, the key way slot 308, the shear ball receptacle 310, the first sealing ring 320, the second sealing ring 322, the third sealing ring 324, the fourth sealing ring 326, the fifth sealing ring 328, the mechanical opening and closing seat sleeve port holes 314, the hydraulic modification area 312, the bomb seat 316, and the closing plug seat 334 respectively, shown in FIG. 3.

The bottom portion 404 includes the hydraulic tube assembly 430 and the hydraulic seat 432. The hydraulic tube assembly 430 has a top portion 446 and a bottom portion 448. The hydraulic tube assembly 430 contains threads 456, the tenth sealing ring 436, the twelfth sealing ring 438, and the thirteenth sealing ring 440. The hydraulic tube assembly 430 is attached to the modified mechanical opening and closing seat sleeve 412 at the hydraulic modification area 418. The hydraulic modification area 418 is structurally equivalent to the hydraulic modification area 312 of the mechanical opening and closing seat sleeve 300, shown in FIG. 3 and contains threads 454. Threads 454 mate with threads 456 to secure the hydraulic tube assembly 430 to the modified mechanical opening and closing seat sleeve 412.

The hydraulic seat 432 is attached to a pin sub similar to the pin sub 240, shown in FIG. 2. The hydraulic seat 432 contains the eleventh sealing ring 442 and the anti-rotation lug receptacle 450. During drill-out, the anti-rotation lug 444 meshes with the anti-rotation receptacle 450 and locks the hydraulic opening and closing seat sleeve 400 to help prevent rotation.

Referring to FIG. 5, a particular illustrative embodiment of a closing sleeve is depicted and generally designated 500. The closing sleeve 500 operates in a similar manner and is structurally equivalent to the closing sleeve 110, shown in FIG. 1 and the closing sleeve 210, shown in FIG. 2. The closing sleeve 500 contains a top portion 502 and a bottom portion 504. The top portion 502 is wide enough to accommodate the mechanical opening and closing seat sleeve 300 shown in FIG. 3 and the hydraulic opening and closing seat sleeve 400 shown in FIG. 4. The bottom portion 504 includes L-shaped slot 506, shear means receptacle 510, and a snap ring groove 512. The top portion includes an anti-rotation tab 514. Interposed between the top portion 502 and the bottom portion 504 are closing sleeve port holes 508.

Figure 6:
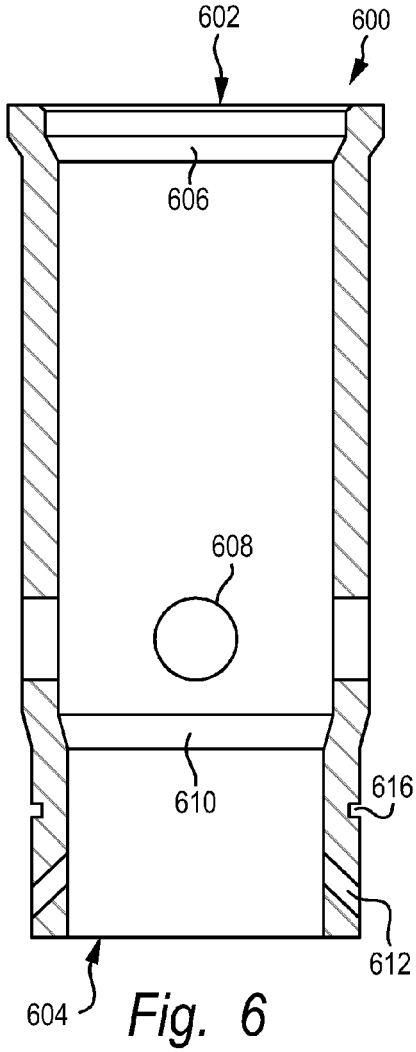
FIG. 6 is a cross sectional view of a three stage insert.

Referring to FIG. 6, a particular illustrative embodiment of a three stage insert depicted and generally designated 600. In a particular embodiment, the mechanical stage cementing collar 100 shown in FIG. 1 includes a three stage insert. The three stage insert is an inside diameter reducer and is used to convert a standard mechanical stage cementing collar to what is known as a three stage tool used in the second stage cementing position in the casing string. The three stage insert 600 is used to decrease the inside diameter of a stage cementing tool that is furthest down the wellbore to accommodate a bomb and a closing plug that pass through an upper or closest to the surface stage cementing tool that assumes the third stage cementing position. In one embodiment, the closing plug seat 248 of the hydraulic opening and closing seat sleeve 208, shown in FIG. 2, has an inside diameter that is less than a stage cementing tool above such that a closing plug can pass through the higher stage cementing tool and create a sealing relationship with the closing plug seat 248. Then upon pumping a fluid into the casing string, the closing plug can apply a force to the hydraulic opening and closing seat sleeve 208, shown in FIG. 2, and the closing sleeve 210, shown in FIG. 2, sufficient to shear the closing sleeve shear means 232, shown in FIG. 2.

The three stage insert 600 is used for three stage or four stage jobs. In a particular embodiment, the three stage insert 600 is machined from a single piece of metal. The three stage insert 600 contains a top portion 602 and a bottom portion 604. The top portion 602 contains a closing plug seat 606. The bottom portion 604 contains a bomb seat 610, three-stage insert screw channels 612, and a seal ring 616. The seal ring 616 helps block pressure from getting through a micro-channel when the three stage insert 600 is installed in the mechanical opening and closing seat sleeve 300, shown in FIG. 3. Interposed between the top portion 602 and the bottom portion 604 are three stage insert port holes 608. The closing plug seat 606 operates in a similar manner and is structurally equivalent to the closing plug seat 148, shown in FIG. 1. The bomb seat 610 operates in a similar manner and is structurally equivalent to the bomb seat 146, shown in FIG. 1. The three-stage insert screw channels 612 align with the three-stage insert set screw channels 332, shown in FIG. 3, to accommodate insert screws to secure the three stage insert 600 to the mechanical opening and closing seat sleeve 300 and to align the three stage insert port holes 608 with the mechanical opening and closing seat sleeve port hole 314, shown in FIG. 3.

The three stage insert 600 is a reducer that reduces the inside diameter of the mechanical stage cementing collar 100 shown in FIG. 1 to allow a smaller diameter bomb to be used in a three stage operation. During operation, the smaller diameter bomb passes through an upper stage cementing collar and lands in the bomb seat 610 in the three stage insert 600, allowing for pump pressure supplied at the surface to pressurize the casing string between the surface and the bomb seat 610 to sheer mechanical opening and closing seat sleeve shear means 112, shown in FIG. 1, in the mechanical stage cementing collar 100, shown in FIG. 1. Similarly, a closing plug with a smaller diameter passes through the upper stage cementing collar and lands in the closing plug seat 606 allowing for pump pressure supplied at the surface to pressurize the casing string between the surface and the closing plug seat 610 to sheer closing sleeve shear means 132, shown in FIG. 1, in the closing sleeve 110, shown in FIG. 1. A mechanical stage cementing collar 100 with the three stage insert 600 transitions from a running-in-hole position, to an open position, and to closed position in a similar manner as was described above in relation to the mechanical stage cementing collar 100, shown in FIG. 1, and the mechanical stage cementing collar 700 described in FIG. 7 below. In a particular embodiment, when only two stages will be used, the three stage insert 600 would not be needed.

Figure 7:
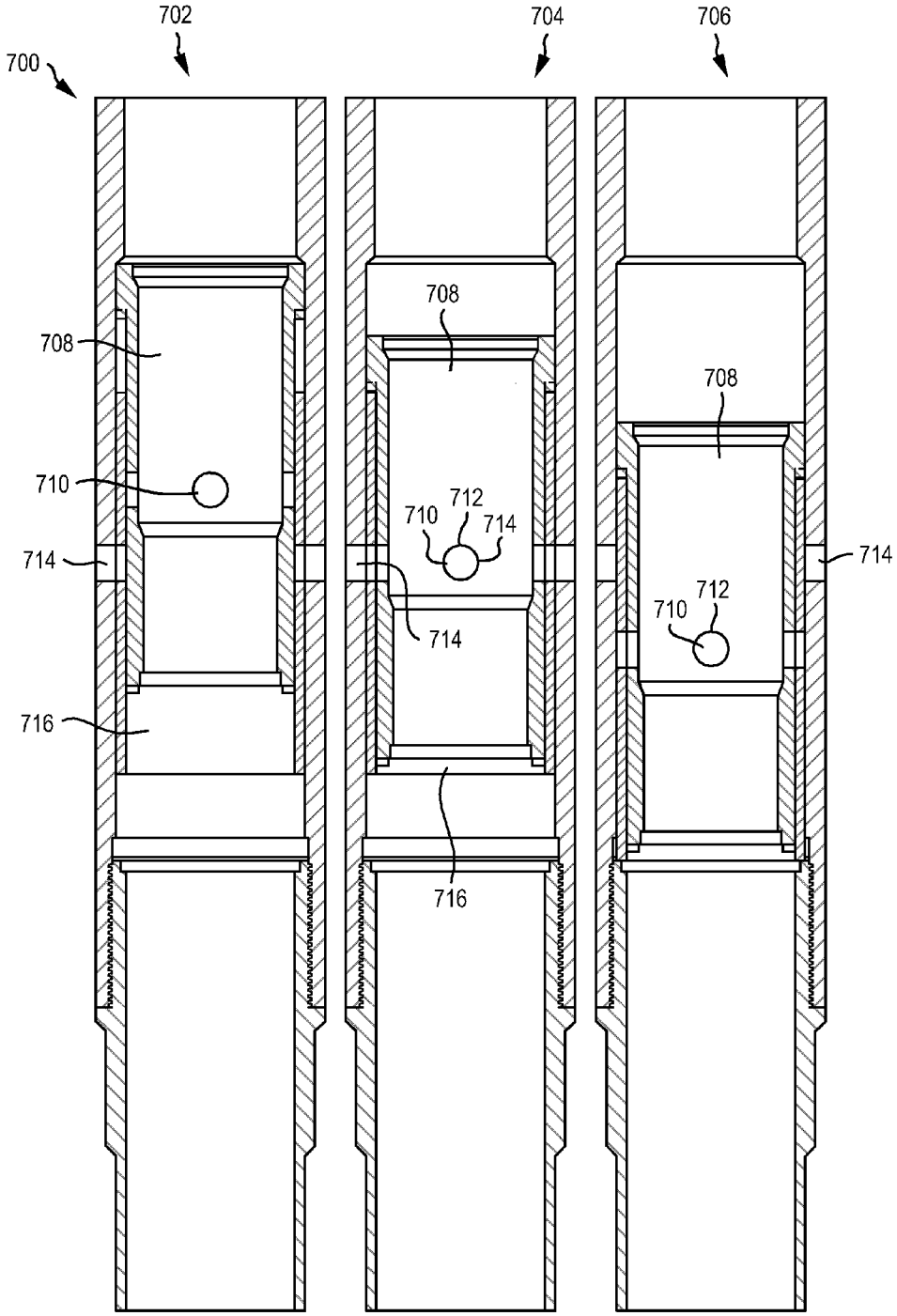
FIG. 7 is a cross sectional view of various stages of a mechanical stage cementing collar in use.

Referring to FIG. 7, a particular illustrative embodiment of the various stages of a mechanical stage cementing collar 700 is depicted. The mechanical stage cementing collar 700 operates in an equivalent manner and is structurally equivalent to the mechanical stage cementing collar 100 shown in FIG. 1. The running-in-hole position 702 is used when the mechanical stage cementing collar 700 is being lowered in a wellbore. After the mechanical stage cementing collar 700 is at a desired position in the wellbore, and a first stage job is complete, the mechanical stage cementing collar 700 transitions to an open position 704.

To transfer the mechanical stage cementing collar 700 to the open position 704, a dropped bomb lands in a bomb seat and pump pressure supplied from the surface shears opening and closing seat sleeve shear means causing a mechanical opening and closing seat sleeve 708 to drop into the open position 704. In the open position 704, mechanical opening and closing seat sleeve port holes 710 line up with closing sleeve port holes 712 and barrel port holes 714 such that annular casing fluid in the casing string can flow through the mechanical opening and closing seat sleeve port holes 710, the closing sleeve port holes 712, and the barrel port holes 714 into an annular cavity of the wellbore. After a desired amount of annular casing fluid has been pumped into the annular cavity, the mechanical stage cementing collar 700 transitions to a closed position 706.

To transfer the mechanical stage cementing collar 700 to the closed position 706, a closing plug is pumped to the cementing collar until the closing plug lands on a closing plug seat. The closing plug creates a sealing relationship, such that upon pumping a fluid, such as drilling mud, into the casing string, the closing plug applies a force to the mechanical opening and closing seat sleeve 708 and the closing sleeve 716 sufficient to shear closing sleeve shear means. Upon shearing the closing sleeve shear means, the opening and closing seat sleeve 708 and the closing sleeve 716 move together downwardly away from the barrel port holes 714 to seal off the mechanical opening and closing seat sleeve port holes 710 and the closing sleeve port holes 712 from the barrel port holes 714 such that the fluid ports are closed and the annular casing fluid cannot flow back into the casing string.

Referring to FIG. 8, a particular illustrative embodiment of the various stages of a hydraulic stage cementing collar 800 is depicted. The hydraulic stage cementing collar 800 operates in an equivalent manner and is structurally equivalent to the hydraulic stage cementing collar 200 shown in FIG. 2. The running-in-hole position 802 is used when the hydraulic stage cementing collar 800 is being lowered in a wellbore. After the hydraulic stage cementing collar 800 is at a desired position in the wellbore, the hydraulic stage cementing collar 800 transitions to an open position 804.

To transfer the hydraulic stage cementing collar 800 to the open position 804, pump pressure is supplied from the surface after a first stage annular casing fluid plug is bumped on the float collar at the bottom of the casing string, thereby pressurizing the entire casing string. Sufficient pressure is applied from the surface to shear opening and closing seat sleeve shear means causing a hydraulic opening and closing seat sleeve 808 to drop into the open position 804. In the open position 804, hydraulic opening and closing seat sleeve port holes 810 line up with closing sleeve port holes 812 and barrel port holes 814 such that annular casing fluid in the casing string can flow through the hydraulic opening and closing seat sleeve port holes 810, the closing sleeve port holes 812, and the barrel port holes 814 into an annular cavity of the wellbore. After a desired amount of annular casing fluid has been pumped into the annular cavity, the hydraulic stage cementing collar 800 transitions to a closed position 806.

To transfer the hydraulic stage cementing collar 800 to the closed position 806, a closing plug is pumped to the cementing collar until the closing plug lands on a closing plug seat. The closing plug creates a sealing relationship, such that upon pumping a fluid, such as drilling mud, into the casing string, the closing plug applies a force to the mechanical opening and closing seat sleeve 808 and the closing sleeve 816 sufficient to shear closing sleeve shear means. Upon shearing the closing sleeve shear means, the opening and closing seat sleeve 808 and the closing sleeve 816 move together downwardly away from the barrel port holes 814 to seal off the hydraulic opening and closing seat sleeve port holes 810 and the closing sleeve port holes 812 from the barrel port holes 814 such that the fluid ports are closed and the annular casing fluid cannot flow back into the casing string.

Those of skill would further appreciate that the various illustrative logical blocks, structures, configurations, modules, and steps described in connection with the embodiments disclosed herein may be implemented in varying ways. Various illustrative structures, components, blocks, configurations, modules, and steps have been described above generally in terms of their functionality. Skilled artisans may implement the described functionality in varying ways for each particular application, but such implementation decisions should not be interpreted as causing a departure from the scope of the present disclosure.

The previous description of the disclosed embodiments is provided to enable any person skilled in the art to make or use the disclosed embodiments. Various modifications to these embodiments will be readily apparent to those skilled in the art, and the generic principles defined herein may be applied to other embodiments without departing from the scope of the disclosure. For example, at least one embodiment described herein may be used in a packer or line hanger. In addition, at least one embodiment may be used in an upside down configuration. Thus, the present disclosure is not intended to be limited to the embodiments shown herein but is to be accorded the widest scope possible consistent with the principles and novel features as defined by the following claims.

What is claimed is:

1. A stage cementing tool comprising:

a closing sleeve;

an opening and closing sleeve shear means;

an opening and closing seat sleeve having a running-in-hole position, an open position, and a closed position, wherein the opening and closing sleeve shear means holds the opening and closing seat sleeve above the closing sleeve such that a differential pressure area is created, wherein the opening and closing seat sleeve isolates port holes during the running-in-hole position when being lowered into a bore hole, wherein the opening and closing sleeve shear means shear after pressure is applied and allow the opening and closing seat sleeve to drop to the closing sleeve such that the opening and closing seat sleeve is in the open position and port holes are open, wherein the opening and closing seat sleeve is used as a mechanical opening and closing seat sleeve when a bomb is dropped into the bore hole and is used as a hydraulic opening and closing seat sleeve when a bomb is not dropped into the bore hole, and the same mechanical parts are used when the opening and closing seat sleeve operates as a mechanical opening and closing seat sleeve as when the opening and closing seat sleeve operates as a hydraulic opening and closing seat sleeve.

2. The stage cementing tool of claim 1, wherein the opening and closing seat sleeve further comprises:

a bomb seat; and opening and closing seat sleeve shear means.

3. The stage cementing tool of claim 1, wherein:

the opening and closing seat sleeve further comprises a closing plug seat; and the closing sleeve comprises closing sleeve shear means.

4. The stage cementing tool of claim 1, wherein the closing sleeve comprises:

an upper snap ring groove that contains a snap ring; and a lower snap ring groove machined in a barrel, wherein in the closed position, the snap ring in the upper snap ring groove locks with the lower snap ring groove to secure the opening and closing seat sleeve and the closing sleeve in the closed position.

5. The stage cementing tool of claim 1, further comprising:

a barrel, wherein the barrel contains an inside portion and barrel port holes, and wherein the opening and closing seat sleeve and the closing sleeve are contained inside the barrel.

6. The stage cementing tool of claim 5, further comprising:

a first sealing ring, wherein in the running-in-hole position, the first sealing ring at least partially isolates a top portion of the opening and closing seat sleeve from the inside of the barrel;

a second sealing ring, wherein the second sealing ring at least partially isolates the opening and closing seat sleeve port holes from the top portion of the opening and the closing seat sleeve, wherein the pressure differential area is located between the first sealing ring and the second sealing ring when the opening and closing seat sleeve is operating as the hydraulic opening and closing seat sleeve;

a fourth sealing ring, wherein the fourth sealing ring at least partially isolates the opening and closing seat sleeve port holes from the top portion of the opening and closing seat sleeve;

a sixth sealing ring, wherein in the running-in-hole position, the sixth sealing ring at least partially isolates the opening and closing seat sleeve port holes from closing sleeve port holes;

a seventh sealing ring, wherein in the running-in-hole position, the seventh sealing ring at least partially isolates the closing sleeve port holes from the bottom portion of the opening and closing seat sleeve; and an eighth sealing ring, wherein in the closed position, the eighth sealing ring at least partially isolates the opening and closing seat sleeve port holes and the closing sleeve port holes from the barrel port holes.

7. The stage cementing tool of claim 6, further comprising:

a third sealing ring proximate to the second sealing ring, wherein the third sealing ring at least partially isolates the opening and closing seat sleeve port holes from the top portion of the opening and closing seat sleeve;

a fifth sealing ring proximate to the fourth sealing ring, wherein the fifth sealing ring at least partially isolates the opening and closing seat sleeve port holes from the top portion of the opening and closing seat sleeve; and a ninth sealing ring proximate to the eighth sealing ring, wherein the ninth sealing ring at least partially isolates the opening and closing seat sleeve port holes and the closing sleeve port holes from the barrel port holes.

8. The stage cementing tool of claim 6, further comprises:

a tenth sealing ring, wherein the tenth sealing ring at least partially isolates pressure inside a hydraulic tube from threads in a hydraulic modification area, wherein the threads are used to secure the hydraulic tube to the opening and closing seat sleeve;

an eleventh sealing ring, wherein the eleventh sealing ring at least partially isolates pressure in the hydraulic tube and a pin sub from the closing sleeve; and a twelfth sealing ring, wherein the twelfth sealing ring helps prevent a pressure differential in an upper portion of the stage cementing tool and a lower portion of the stage cementing tool to prevent pressure from prematurely shearing shear means on the closing sleeve.

9. The stage cementing tool of claim 8 further comprising, a thirteenth sealing ring proximate to the twelfth sealing ring, wherein the thirteenth sealing ring at least partially prevents a pressure differential in an upper portion of the stage cementing tool and a lower portion of the stage cementing tool to prevent pressure from prematurely shearing shear means on the closing sleeve.

10. The stage cementing tool of claim 1, further comprising a three stage insert wherein the three stage insert is machined from a single piece of metal and the three stage insert reduces the inside diameter of the stage cementing tool to allow the stage cementing tool to be used in a three stage operation.

11. A method of casing a wellbore, the method comprising:

inserting a stage cementing tool into a wellbore, wherein the stage cementing tool is in a running-in-hole position and the stage cementing tool comprises a closing sleeve and an opening and closing seat sleeve, wherein the opening and closing seat sleeve isolates port holes during the running-in-hole position when being lowered into a bore hole, wherein the same mechanical parts of the opening and closing seat sleeve are used when the opening and closing seat sleeve operates as a hydraulic opening and closing seat sleeve as when the opening and closing seat sleeve operates as a mechanical opening and closing seat sleeve, transitioning the stage cementing tool into an open position, wherein in the open position annular casing fluid can flow into an annular cavity in the wellbore;

transitioning the stage cementing tool into a closed position, wherein in the closed position annular casing fluid cannot flow from the annular cavity back into the stage cementing tool; and drilling out at least a portion of the stage cementing tool such that the wellbore is cased.

12. The method of claim 11, wherein the opening and closing seat sleeve further comprises:

a bomb seat, wherein the bomb seat is used to accommodate a bomb dropped into the casing string that contains the stage cementing tool to help create sufficient pressure in the opening and closing seat sleeve to shear opening and closing seat sleeve shear means and transition the stage cementing tool from the running-in-hole position to the open position.

13. The method of claim 12, wherein the opening and closing seat sleeve further comprises:

a closing plug seat, wherein the closing plug seat is used to accommodate a closing plug dropped into the casing and then pumped to the stage cementing tool to help create sufficient pressure above the opening and closing seat sleeve and the closing sleeve to shear closing sleeve shear means and transition the stage cementing tool from the open position to the closed position.

14. The method of claim 11, wherein the closing sleeve comprises:

an upper snap ring groove that contains a snap ring; and a lower snap ring groove, wherein in the closed position, the snap ring in the upper snap ring groove locks with the lower snap ring groove to secure the opening and closing seat sleeve and the closing sleeve in the closed position.

15. The method of claim 11, wherein the stage cementing tool further comprises:

a first sealing ring, wherein in the running-in-hole position, the first sealing ring at least partially isolates a top portion of the opening and closing seat sleeve from the inside of a barrel;

a second sealing ring, wherein the second sealing ring at least partially isolates opening and closing seat sleeve port holes from the top portion of the opening and the closing seat sleeve;

a fourth sealing ring, wherein the fourth sealing ring at least partially isolates the opening and closing seat sleeve port holes from the top portion of the opening and closing seat sleeve;

a sixth sealing ring, wherein in the running-in-hole position, the sixth sealing ring at least partially isolates the opening and closing seat sleeve port holes from closing sleeve port holes;

a seventh sealing ring, wherein in the running-in-hole position, the seventh sealing ring at least partially isolates the closing sleeve port holes from the bottom portion of the opening and closing seat sleeve; and an eighth sealing ring, wherein in the closed position, the eighth sealing ring at least partially isolates the opening and closing seat sleeve port holes and the closing sleeve port holes from barrel port holes.

16. The method of claim 11, further comprising:

inserting a hydraulic tube assembly into the opening and closing seat sleeve at the hydraulic modification area; and adding a hydraulic seat to the pin sub.

17. The method of claim 16, further comprising threading at least a portion of the hydraulic modification area before inserting the hydraulic tube assembly into the opening and closing seat sleeve.

18. The method of claim 16, wherein the stage cementing tool further comprises:

a tenth sealing ring, wherein the tenth sealing ring at least partially isolates pressure inside the hydraulic tube from threads in the hydraulic modification area, wherein the threads are used to secure the hydraulic tube to the opening and closing seat sleeve;

an eleventh sealing ring, wherein the eleventh sealing ring at least partially isolates pressure in the hydraulic tube and a pin sub from the closing sleeve; and a twelfth sealing ring, wherein the twelfth sealing ring prevents a pressure differential in an upper portion of the stage cementing tool and a lower portion of the stage cementing tool to prevent pressure from prematurely shearing shear means on the closing sleeve.

19. A stage cementing tool comprising:

a closing sleeve;

an opening and closing sleeve shear means; and an opening and closing seat sleeve having a running-in-hole position, an open position, and a closed position, wherein the opening and closing sleeve shear means holds the opening and closing seat sleeve above the closing sleeve such that a differential pressure area is created inside the stage cementing tool, wherein the opening and closing seat sleeve isolates port holes during the running-in-hole position, wherein the opening and closing sleeve shear means shear after pressure is applied and allow the opening and closing seat sleeve to drop to the closing sleeve such that the opening and closing seat sleeve is in the open position and port holes are open, and wherein the same mechanical parts are used when the opening and closing seat sleeve operates as a mechanical opening and closing seat sleeve as when the opening and closing seat sleeve operates as a hydraulic opening and closing seat sleeve.

20. The stage cementing tool of claim 19, further comprising:

a first sealing ring, wherein in the running-in-hole position, the first sealing ring at least partially isolates a top portion of the opening and closing seat sleeve from the inside of a barrel that includes the opening and closing seat sleeve;

a second sealing ring, wherein the second sealing ring at least partially isolates opening and closing seat sleeve port holes from the top portion of the opening and the closing seat sleeve, wherein a pressure differential area is located between the first sealing ring and the second sealing ring when the opening and closing seat sleeve is operating as the hydraulic opening and closing seat sleeve.

* * * * *